US006672055B1

(12) United States Patent
Konishi et al.

(10) Patent No.: US 6,672,055 B1
(45) Date of Patent: Jan. 6, 2004

(54) HYDRAULIC PUMP CONTROL DEVICE

(75) Inventors: Hideo Konishi, Tokyo (JP); Kenji Arai, Tokyo (JP); Seiichi Akiyama, Tokyo (JP); Masumi Nomura, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 275 days.

(21) Appl. No.: 09/869,924

(22) PCT Filed: Nov. 13, 2000

(86) PCT No.: PCT/JP00/07125

§ 371 (c)(1),
(2), (4) Date: Jul. 9, 2001

(87) PCT Pub. No.: WO01/36828

PCT Pub. Date: May 25, 2001

(30) Foreign Application Priority Data

Nov. 18, 1999 (JP) ..... 11/328744

(51) Int. Cl.[7] ..... F16D 31/02
(52) U.S. Cl. ..... 60/449; 60/452
(58) Field of Search ..... 60/449, 452, 445, 60/431

(56) References Cited

U.S. PATENT DOCUMENTS 5,267,441 A 12/1993 Devier et al.
5,911,506 A 6/1999 Nakamura et al.
5,944,492 A 8/1999 Konishi et al.

FOREIGN PATENT DOCUMENTS

| | | |
|---|---|---|
| EP | 0 539 589 | 2/1992 |
| EP | 0 851 122 A2 | 7/1998 |
| EP | 0 884 422 | 12/1998 |
| EP | 0 908 564 A2 | 4/1999 |
| JP | 8-333769 | 12/1996 |
| JP | 10-196606 | 7/1998 |
| JP | 11-108003 | 4/1999 |

*Primary Examiner*—Edward K. Look
*Assistant Examiner*—Michael Leslie
(74) *Attorney, Agent, or Firm*—Morrison & Foerster LLP

(57) ABSTRACT

Disclosed herein is a hydraulic-pump controller that is capable of controlling absorbed pump torque in good balance against engine output at all times. In this hydraulic-pump controller, the discharge flow rates of the operating oil that are discharged from hydraulic pumps (9, 10) according to manipulation of manipulation units (12, 13) are predicted based on the discharge pressure of the hydraulic pumps (9, 10) that are driven by an engine (1), and based on the manipulation amount of the manipulation units (12, 13) that manipulate hydraulic actuators (27, 28), or a physical quantity correlating with the manipulation amount. Based on the predicted discharge flow rates and the discharge pressure, the absorbed torque of the hydraulic pumps is computed. Then, the predictive engine speed of the engine (11) is computed from the absorbed torque of the hydraulic pumps (9, 10) computed. Based on the deviation between the computed predictive engine speed and the actual engine speed of the engine (11), the regulators (12, 13) of the hydraulic pumps (9, 10) are controlled.

4 Claims, 9 Drawing Sheets

| | | PUMP DISCHARGE PRESSURE Pp | | | | | | | |
|---|---|---|---|---|---|---|---|---|---|
| | | NB | NM | NS | ZO | PS | PM | PB | ij= |
| PREDICTIVE TOTAL FLOW RATE Q | NB | W11 | W12 | W13 | W14 | W15 | W16 | W17 | 1j |
| | NM | W21 | W22 | W23 | W24 | W25 | W26 | W27 | 2j |
| | NS | W31 | W32 | W33 | W34 | W35 | W36 | W37 | 3j |
| | ZO | W41 | W42 | W43 | W44 | W45 | W46 | W47 | 4j |
| | PS | W51 | W52 | W53 | W54 | W55 | W56 | W57 | 5j |
| | PM | W61 | W62 | W63 | W64 | W65 | W66 | W67 | 6j |
| | PB | W71 | W72 | W73 | W74 | W75 | W76 | W77 | 7j |
| | ij= | i1 | i2 | i3 | i4 | i5 | i6 | i7 | |

| | | FIRST-ORDER DIFFERENTIATION OF PREDICTIVE ENGINE SPEED dΔNe | | | | | | | |
|---|---|---|---|---|---|---|---|---|---|
| | | NB | NM | NS | ZO | PS | PM | PB | ij= |
| SECOND-ORDER DIFFERENTIATION $d^2\Delta Ne$ | NB | W11 | W12 | W13 | W14 | W15 | W16 | W17 | 1j |
| | NM | W21 | W22 | W23 | W24 | W25 | W26 | W27 | 2j |
| | NS | W31 | W32 | W33 | W34 | W35 | W36 | W37 | 3j |
| | ZO | W41 | W42 | W43 | W44 | W45 | W46 | W47 | 4j |
| | PS | W51 | W52 | W53 | W54 | W55 | W56 | W57 | 5j |
| | PM | W61 | W62 | W63 | W64 | W65 | W66 | W67 | 6j |
| | PB | W71 | W72 | W73 | W74 | W75 | W76 | W77 | 7j |
| | ij= | i1 | i2 | i3 | i4 | i5 | i6 | i7 | |

HYDRAULIC PUMP CONTROL DEVICE

TECHNICAL FIELD

The present invention relates to a controller for a hydraulic pump, and more particularly to a hydraulic pump controller suitable for use with hydraulic construction machines.

BACKGROUND ART

Generally, the power unit system (hydraulic system) of a hydraulic construction machine is equipped with one or a plurality of variable displacement type hydraulic pumps which are driven by engine power. For example, a hydraulic system for a hydraulic shovel that is a typical hydraulic construction machine is equipped with first and second variable displacement type hydraulic pumps 9 and 10 which are driven by power from an engine 11, as shown in FIG. 12. The discharge pressure oil from these hydraulic pumps 9 and 10 is supplied to a plurality of hydraulic actuators 27 and 28 through direction switching valves 15 and 17 where the opening degree varies according to the amount that manipulation levers 19 and 20 are manipulated. To supply adequate amount of pressure oil to the hydraulic actuators 27 and 28 that are compositely manipulated, it is necessary to control absorbed pump torque in good balance against engine output so that an actual engine speed can follow a target engine speed.

Hence, the hydraulic system is equipped with a controller 30 to which sensor signals are input from an engine speed sensor 22 and a pressure switch 31. In the controller 30, the engine speed of an engine 11 is detected based on an input signal from the engine speed sensor 22, and it is decided, based on an input signal from the pressure sensor 31, whether or not the hydraulic pumps 9 and 10 are discharging pressure oil. And to control the absorbed torque (or absorbed horse power) of the hydraulic pumps 9 and 10 so that the engine speed follows the target engine speed, a control signal Ps is output to regulators 12 and 13 that regulate the discharge flow rates of the hydraulic pumps 9 and 10. In an electromagnetic proportional pressure-reducing valve 14, electro-oil conversion is performed on the control signal Ps, and the converted signal is input to the regulators 12 and 13.

The aforementioned conventional hydraulic-pump controller, however, cannot predict changes in the discharge flow rates of the hydraulic pumps 9 and 10 caused by manipulation of the manipulation levers 19 and 20. Because of this, when the discharge flow rates of the hydraulic pumps 9 and 10 are transiently changed, for example, immediately after manipulation of the manipulation levers 19 and 20, or during slight manipulation, the balance between engine output and absorbed pump torque will be lost and a fluctuation in an actual engine speed relative to a target engine speed will become great. As a result, adequate amount of pressure oil cannot be supplied to the hydraulic actuators 27 and 28, and operability is degraded.

Further, with the conventional hydraulic-pump controller, it is necessary to perform tuning of control parameters in accordance with the type of the hydraulic shovels. That is, there is a need to amend part of the control program for each hydraulic shovel type. Besides, there is an individual difference between hydraulic shovels, even if they are of the same type. Furthermore, there are cases where working environment varies, for example, between a cold district and a warm district, and where engine fuel is changed. Thus, if individual difference, working environment, and conditions vary, tuning of control parameters, performed before shipping hydraulic shovels, will no longer be adaptable and therefore a fluctuation in an actual engine speed relative to a target engine speed will become great and will degrade operability.

The present invention has been made in view of such problems. Accordingly, it is an object of the present invention to provide a hydraulic-pump controller that is capable of controlling absorbed pump torque in good balance against engine output at all times.

Another object of the invention is to provide a hydraulic-pump controller which eliminates the necessity of tuning control parameters and amending a control program, even in the case where there is an individual difference between hydraulic construction machines, or the case where working environment varies, or the case where it is installed in a different type of hydraulic construction machine.

DISCLOSURE OF THE INVENTION

In accordance with the present invention, there is provided a hydraulic-pump controller which is equipped in a hydraulic system, in which hydraulic pumps are driven by an engine so that operating oil is supplied to hydraulic actuators manipulated by manipulation means, and which also controls regulators of the hydraulic pumps so that absorbed torque of the hydraulic pumps balances with an output of the engine, the hydraulic-pump controller comprising:

- engine speed detection means for detecting engine speed of the engine;
- discharge pressure detection means for detecting discharge pressure of the hydraulic pumps;
- manipulation-amount detection means for detecting an amount that the manipulation means is manipulated, or a physical quantity correlating with the amount;
- discharge flow rate predicting means for predicting discharge flow-rates of the operating oil which are discharged from the hydraulic pumps according to manipulation of the manipulation means, based on an output of the discharge pressure detection means and an output of the manipulation-amount detection means;
- predictive engine speed computing means for calculating the absorbed torque of the hydraulic pumps, based on the discharge flow rates predicted by the discharge flow rate predicting means and an output of the discharge pressure detection means, and then computing a predictive engine speed of the engine from the calculated absorbed torque of the hydraulic pumps; and
- regulator control means for controlling the regulators, based on a deviation between the predictive engine speed computed by the predictive engine speed computing means and an actual engine speed detected by the engine speed detection means.

With this construction, the discharge flow rates of the operating oil, that are discharged from the hydraulic pumps being operated can be predicted according to manipulation of the manipulation means, based on the discharge pressure of the hydraulic pumps, and based on the manipulation amount of the manipulation means, or a physical quantity correlating with the manipulation amount. Therefore, it is possible to make the actual engine speed of the engine follow the predictive engine speed, without losing the balance between the engine output and the absorbed pump torque, immediately after lever manipulation, or during slight manipulation. Thus, the hydraulic-pump controller of the present is capable to of preventing operability degradation due to engine speed fluctuations.

In a preferred form of the present invention, the regulator control means is a means for controlling the regulators by employing fuzzy reasoning. The regulator control means includes conformability computing means for setting a plurality of antecedent conditions in accordance with a range of operating states of the hydraulic system and then computing conformability of each antecedent condition relative to physical quantities representing the operating states, and learning-correction means for setting a plurality of control parameters for controlling the regulators, in accordance with the antecedent conditions, and for learning and correcting each of the control parameters, based on both the deviation between the predictive engine speed and the actual engine speed and the conformability of each antecedent condition computed by the conformability computing means, and then outputting the corrected control parameters to the regulators.

Thus, the hydraulic-pump controller is robust in control, because it employs fuzzy reasoning to control the regulators. In addition, based on the conformability of each antecedent condition relative to a quantity representing the operating state of the hydraulic system, and based on the deviation between the actual engine speed and the predictive engine speed, the control parameters are learned and corrected and are output to the regulators. Thus, the hydraulic-pump controller is capable of manipulating the absorbed torque of the hydraulic pumps according to the output states of the hydraulic pumps and the response of the engine speed. Even in the case where the operating state of the hydraulic system varies, for instance, there is an individual difference between hydraulic construction machines, or the case where working environment varies, and furthermore, even in the case where it is installed in a different type of hydraulic construction machine, the hydraulic-pump controller is capable of eliminating the tuning of the control parameters and the operation to change a control program.

In another preferred form of the present invention, the discharge pressure and the discharge flow rates are treated as the physical quantities representing the operating states, and the antecedent conditions are set in accordance with the discharge pressure and the discharge flow rates. In still another preferred form of the present invention, a first-order differentiated value and a second-order differentiated value of the predictive engine speed are treated as the physical quantities representing the operating states, and the antecedent conditions are set in accordance with the first-order differentiated value and the second-order differentiated value.

BEST MODE FOR CARRYING OUT THE INVENTION

Figure 1:
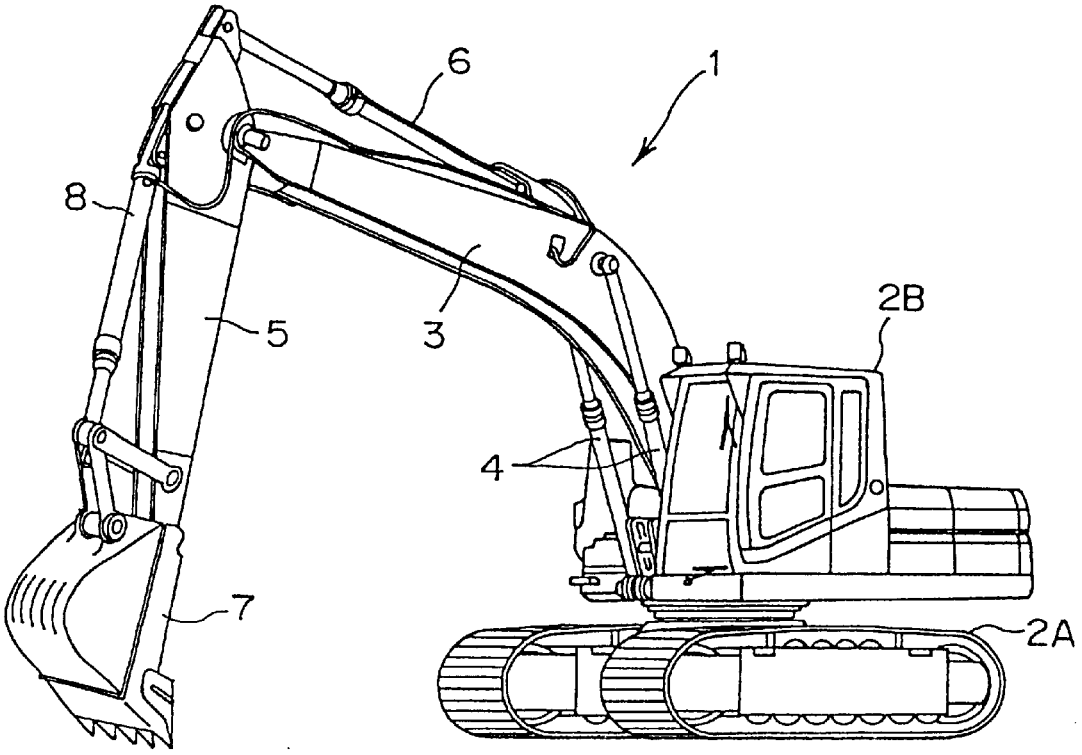
FIG. 1 is a perspective view of a general hydraulic shovel to which a hydraulic-pump controller as a first embodiment of the present invention is applied.

A hydraulic-pump controller according to a first embodiment of the present invention will hereinafter be described with reference to the drawings. Initially, a description will be given of the construction of a general hydraulic shovel to which the hydraulic-pump controller is applied. As shown in FIG. 1, the hydraulic shovel 1 is equipped with an upper swivel base 2B, which is free to swivel with respect to a lower travel base 2A. A boom 3 extends from the upper swivel base 2B, whose outer end is connected to a stick 5. The stick 5 has a bucket 7 at its outer end. Within the swivel base 2B, the hydraulic shovel 1 is equipped with an engine and hydraulic pumps (not shown) in addition to a swivel motor (not shown) for swiveling the upper swivel base 2B. The hydraulic, pumps are used for supplying pressure oil to hydraulic actuators such as a boom cylinder 4 for operating the boom 3, a stick cylinder 6 for operating the stick 5, a bucket cylinder 8 for operating the bucket 7, etc. The fundamental constructions of these cylinders are as in the conventional hydraulic shovel.

Figure 2:
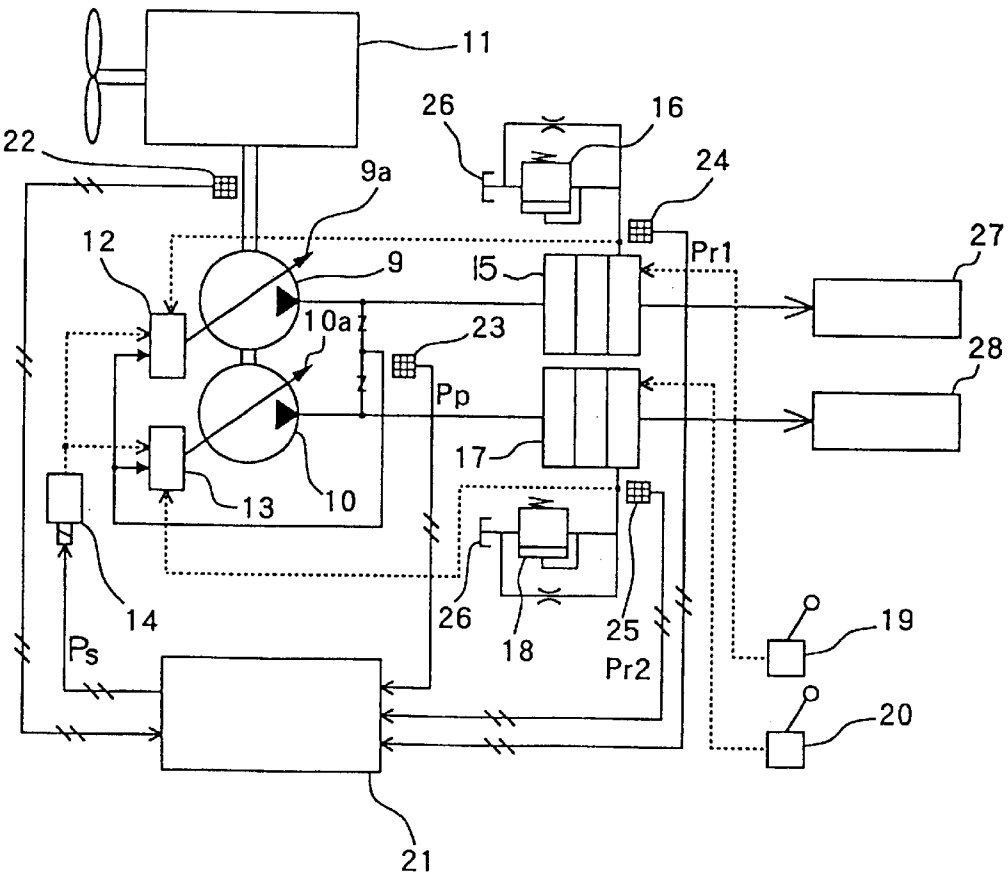
FIG. 2 is a block diagram showing the construction of a hydraulic system used in the hydraulic-pump controller of the first embodiment of the present invention.

The hydraulic-pump controller of the present invention is applied to the above-mentioned hydraulic construction machine such as a hydraulic shovel, etc. The first embodiment of the hydraulic-pump controller will hereinafter be described with reference to FIGS. 2 to 8. Note that the same reference numerals will be applied to the same parts as the aforementioned prior art. As shown in a block diagram of FIG. 2, a hydraulic system according to the hydraulic-pump controller of the first embodiment is equipped with an engine (diesel engine) 11, and first and second variable displacement-type hydraulic pumps (hereinafter referred simply as hydraulic pumps) 9 and 10 which are driven by power from engine 11. These hydraulic pumps 9 and 10 are constructed as a swash plate type axial piston pumps in which the discharge flow rate varies based on the angular displacement of swash plates 9*a* and 10*a*, respectively. The swash plates 9*a* and 10*a* are caused to move by regulators 12 and 13, respectively.

The regulator 12 receives a control signal (circuit pressure) Ps obtained through electro-oil conversion by an electromagnetic proportional pressure-reducing valve 14, circuit pressure between a direction switching valve 15 and a relief valve 16, and circuit pressure of the discharging portions of the first and second hydraulic pumps 9 and 10. The regulator 13 receives the control signal (circuit pressure) Ps obtained through electro-oil conversion by the electromagnetic proportional pressure-reducing valve 14, circuit pressure between a direction switching valve 17 and a relief valve 18, and the circuit pressure of the discharging portions of the first and second hydraulic pumps 9 and 10. The regulators 12 and 13 are controlled by these oil pressures. Note that the details of how hydraulic control is performed by the regulators 12 and 13 will be described later.

The direction switching valves 15 and 17 are devices for switching the quantity and direction of the pressure oil that is supplied to the hydraulic actuators 27 and 28. By manipulating manipulation levers (manipulation means) 19 and 20, manipulation pressure according to the amount of the lever manipulation is input to the direction switching valves 15 and 17. The direction switching valves 15 and 17 perform the operation of switching the quantity and direction of the pressure oil. The relief valve 16 is provided in a hydraulic circuit that the pressure oil being passed through the direction switching valve 15 flows into a tank 26. Similarly, the relief valve 18 is provided in a hydraulic circuit that the pressure oil being passed through the direction switching valve 17 flows into a tank 26. The relief valves 16 and 18 are opened when the circuit pressure reaches a predetermined relief installation pressure. The relief valve 16 is also provided with a choke in parallel. Likewise, the relief valve 18 is provided with a choke in parallel. A change in the quantity of the oil that flows into the tank 26 is sensed by pressure change caused on the upstream side of the choke.

With such a construction, in the case where the amount that the manipulation levers 19 and 20 are manipulated is zero, the pressure oil, discharged from the hydraulic pumps 9 and 10, flows into the tank 26 through the direction switching valves 15 and 17 and the relief valves 16 and 18. When this occurs, the inlet pressures at the relief valves 16 and 18 are equal to the relief installation pressure. If, on the other hand, the manipulation levers 19 and 20 are manipulated, the pressure oil being passed through the direction switching valves 15 and 17 is supplied to the hydraulic actuators 27 and 28. Since no pressure oil passes through the relief valves 16 and 18, the inlet pressures at the relief valves 16 and 18 are reduced near the tank pressure. That is, the inlet pressures at the relief valves 16 and 18 change according to the amount that the manipulation levers 19 and 20 are manipulated. The inlet pressures are transmitted to the regulators 12 and 13.

And the above-mentioned hydraulic system is equipped with a controller 21 for controlling operation of the hydraulic pumps 9 and 10. The controller 21 receives a signal (actual engine speed) Ne from an engine speed sensor (engine speed detection sensor) 22 for detecting the engine speed of the engine 11, a signal (hydraulic pump discharge pressure) Pp from a pressure sensor (discharge pressure, detection means) 23 for detecting an average pressure (discharge pressure) between the hydraulic pumps 9 and 10, and signals (inlet pressures) Pr1 and Pr2 from pressure sensors (manipulation-amount detection means) 24 and 25 for detecting the inlet pressures of the relief valves 16 and 18. Based on these input signals, the controller 21 sets a control signal (control pressure) Ps for controlling the hydraulic pumps 9 and 10 and outputs it to the electromagnetic proportional pressure-reducing valve 14.

Figure 3:
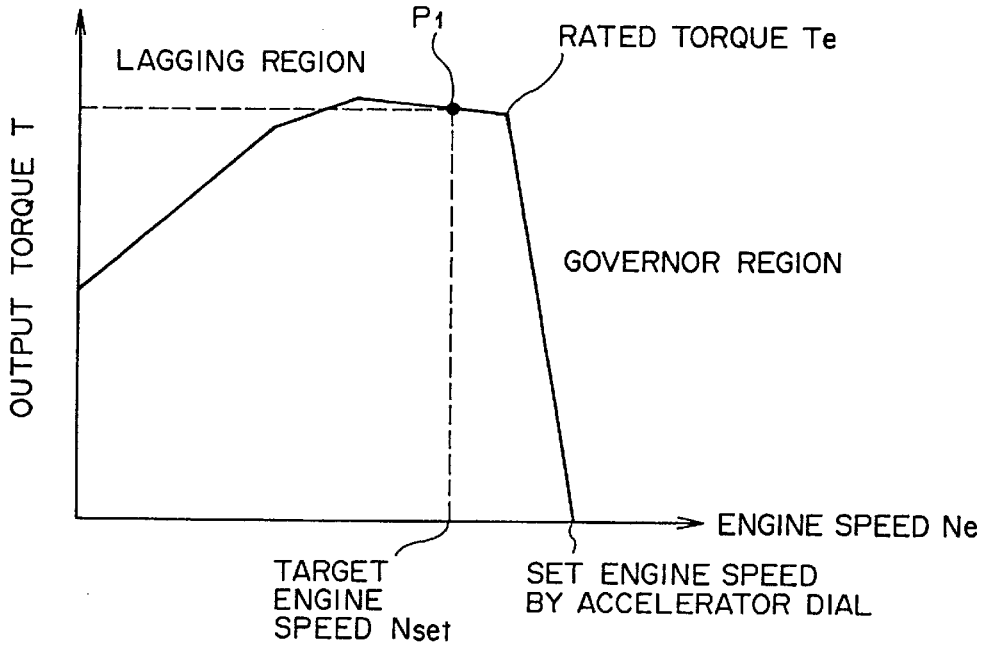
FIG. 3 is an explanatory diagram showing the relationship between the engine output characteristic and the target engine speed, used in the hydraulic-pump controller of the first embodiment of the present invention.
Figure 4:
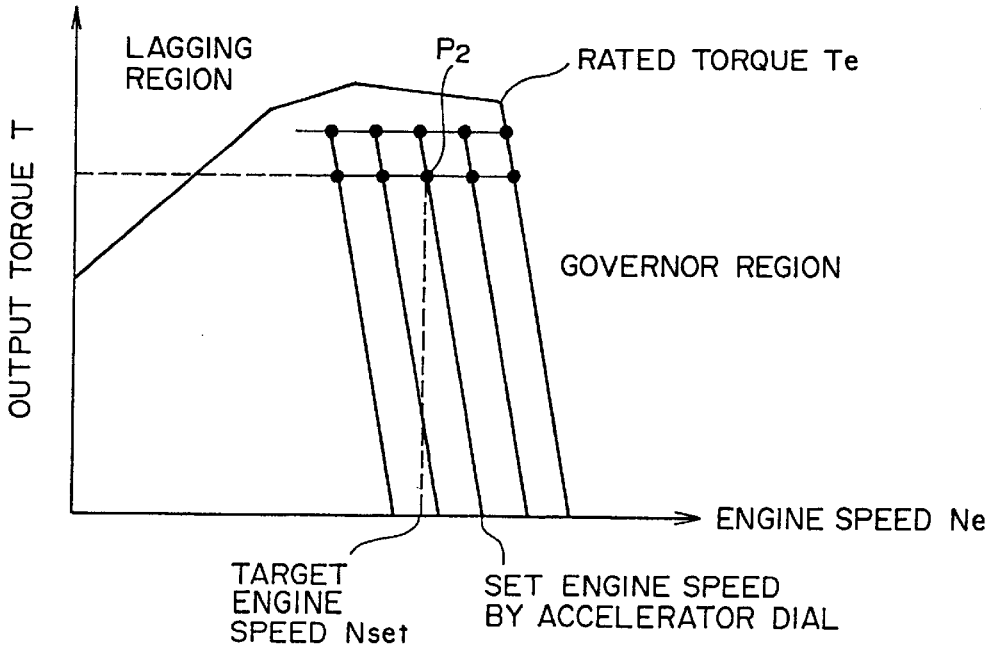
FIG. 4 is an explanatory diagram showing the relationship between the engine output characteristic and the target engine speed, used in the hydraulic-pump controller of the first embodiment of the present invention.

A description will hereinafter be made of how the control pressure (output value to the electromagnetic proportional pressure-reducing valve 14) Ps is set by the controller 21, with reference to FIGS. 3 to 5. FIGS. 3 and 4 show the relationship between the engine output characteristic and the target engine speed. FIG. 3 shows the case where an engine output of 100% is used, while FIG. 4 shows the case where a set engine speed by an accelerator dial is changed to reduce the engine output to less, than 100%. The engine output is divided into a governor region and a lagging region with the point of a rated torque Te (rated point) as the boundary. The governor region is an output region where the governor opening degree is less than 100%, while the lagging region is an output region where the governor opening degree is 100%.

In the case where heavy digging is performed by a hydraulic shovel, the engine output is set to 100%, and in order to perform operation in an optimal fuel consumption state, a target point is taken as shown at point $p_1$ in FIG. 3. That is, a target engine speed Nset is set to a point that is a little lower than the rated engine speed on the characteristic line indicating an output of 100% (engine speed at the rated point). On the other hand, in the case of light digging operation, there are cases where the operation can be performed with an engine output of less than 100%, and where a set engine speed by the accelerator dial can also be reduced. Because of this, as shown at point $p^2$ in FIG. 4, within the region surrounded by both the characteristic line indicating an output of 100% and the characteristic line indicating the accelerator dial maximum, a target point is taken according to engine load and to a set engine speed by the accelerator dial. In this case, the abscissa value of the target point represents the target engine speed and the ordinate value represents the target engine output torque.

Figure 5:
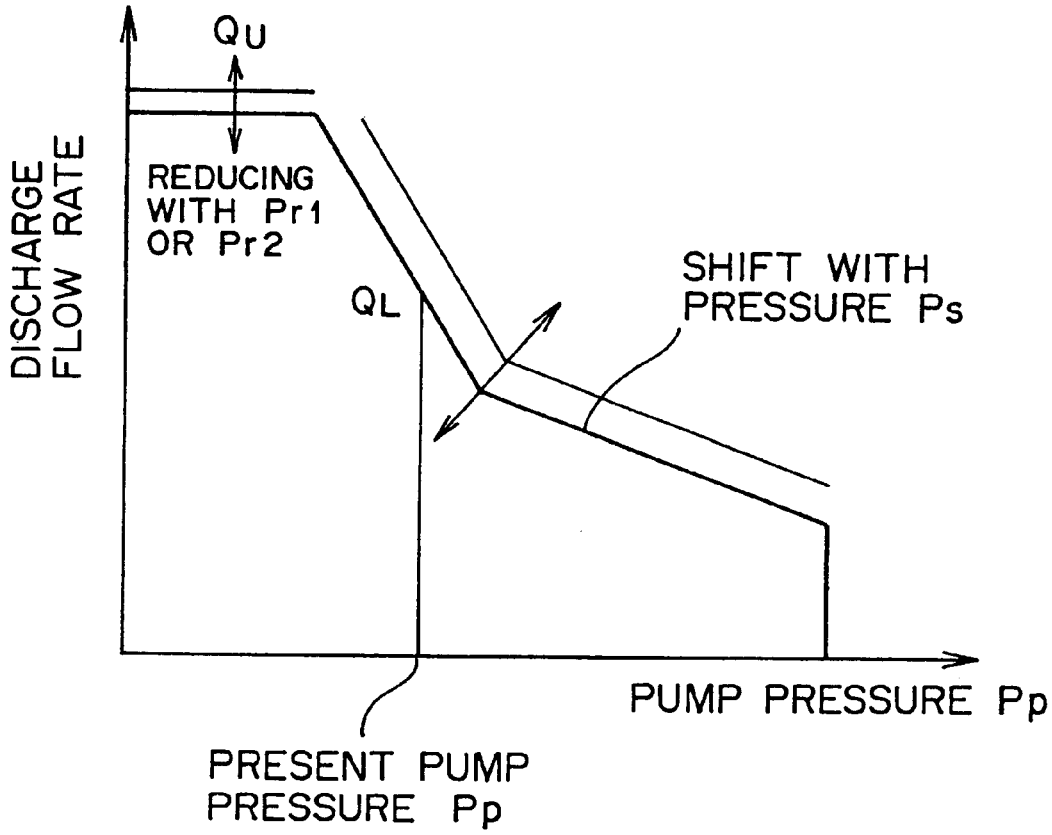
FIG. 5 is an explanatory diagram showing the regulator characteristic of the hydraulic pump used in the hydraulic-pump controller of the first embodiment of the present invention.
Figure 6:
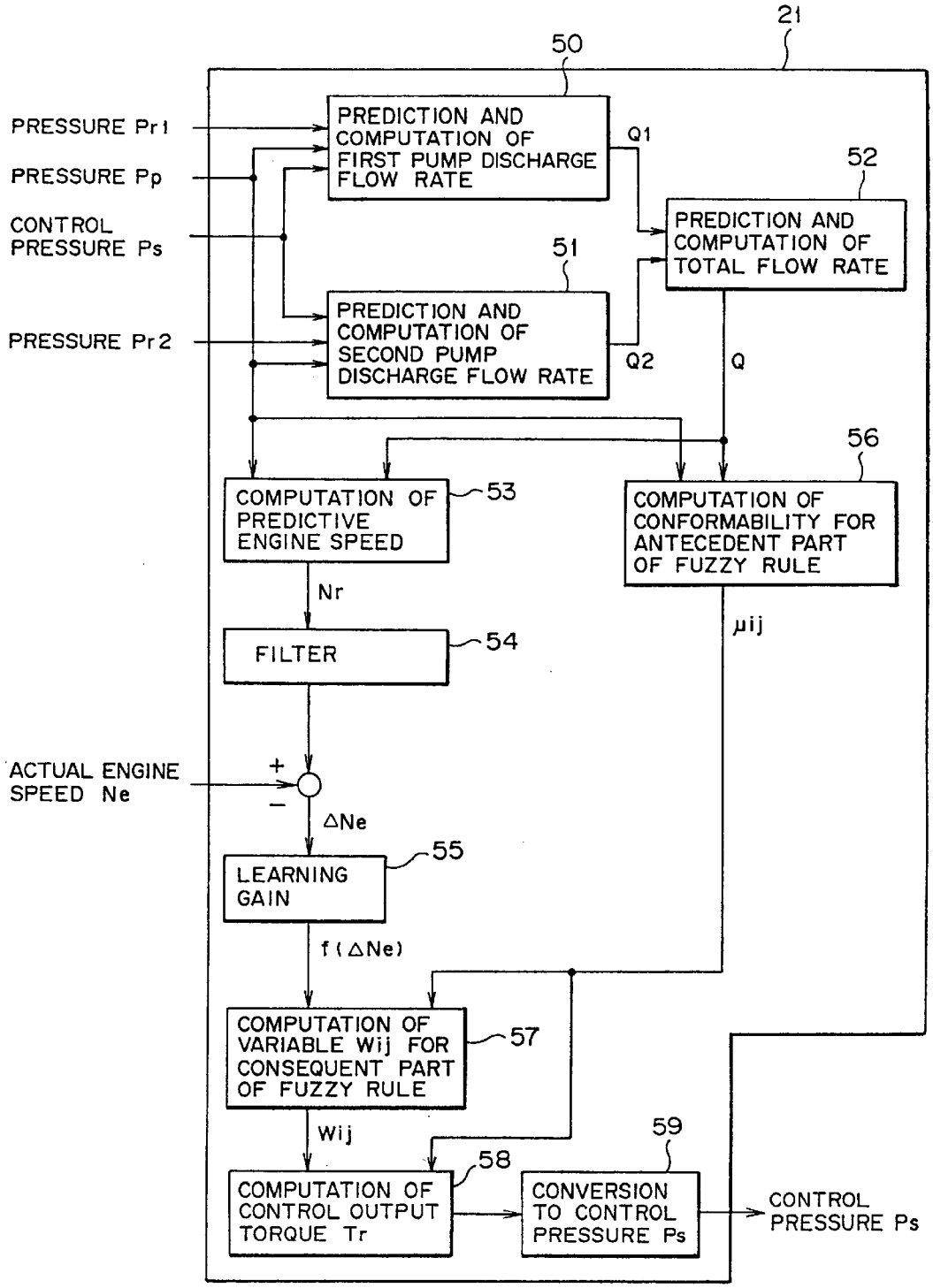
FIG. 6 is a block diagram showing the computation for pump control used in the hydraulic-pump controller of the first embodiment of the present invention.

Next, FIG. 5 represents the regulator characteristic of the hydraulic pump. In the case where the discharge pressure Pp of the hydraulic pumps 9 and 10 is low, the maximum discharge flow rate $Q_U$ of the hydraulic pumps 9, and 10 is increased or decreased according to the inlet pressure Pr1 of the relief valve 16 which varies with the amount that the manipulation lever 19 is manipulated, or the inlet pressure Pr2 of the relief valve 18 which varies with the amount the manipulation lever 20 is manipulated. More specifically, the maximum discharge flow rate $Q_U$ is represented by the following Eq. (1):

$$Q_U = a \times Pr + b \tag{1}$$

where a and b are a proportional coefficient, indicating the flow-rate characteristic of the discharge flow rate $Q_U$, and a constant, respectively. Therefore, for instance, in the case where the amount that the manipulation levers 19 and 20 are manipulated is small, the regulators 12 and 13 are operated so that the discharge flow rate $Q_U$ becomes low.

In the case where the discharge pressure Pp of the hydraulic pumps 9 and 10 is medium and high the discharge flow rate $Q_L$ is reduced with a rise in the hydraulic pump discharge pressure Pp. This pressure region (region indicated by an oblique characteristic line in FIG. 5) is a region where the absorbed torque (or absorbed horse power) of the hydraulic pumps 9 and 10 becomes constant. The above-mentioned characteristic line is called a torque constant curve or a horse power constant curve. If the control pressure Ps to the electromagnetic proportional pressure-reducing valve 14 is varied, the above-mentioned torque constant curve will be shifted according to the magnitude of the control pressure Ps, as shown by an arrow in FIG. 5. As a result, the absorbed pump torque will be varied. More specifically, the discharge flow rate $Q_L$ is represented by the following. Eq. (2):

$$Q_L=c\times(Pp+k\times Ps)+d \quad (2)$$

where c and d are a proportional coefficient, indicating the flow rate characteristic of the discharger flow rate $Q_L$, and a constant, and k is a coefficient relative to the control pressure Ps. However, each of the coefficients c, d, and k varies between a region where the discharge pressure Pp is relatively high and a region where the discharge pressure Pp is relatively low. Because of this, the characteristic line $Q_L$ represented by the aforementioned Eq. (2) becomes a line such as that shown in FIG. 5.

From the foregoing description, the maximum discharged flow rate $Q_U$ of the hydraulic pump 9 or 10 can be estimated by pressure Pr1 or Pr2, and it becomes possible to estimate the discharge flow rate $Q_L$ on the torque constant curve by the control pressure Ps and the hydraulic pump discharge pressure Pp. And the present pump discharge flow rate $Q_A$ can be estimated by the following Eq. (3), employing $Q_U$ and $Q_L$:

$$Q_A=\max[\min(Q_U, Q_L), 0] \quad (3)$$

The controller 21 sets the control pressure Ps to be output, employing the above-mentioned relationship between the engine output characteristic and the target engine speed, and also employing the regulator characteristic of the hydraulic pump (FIG. 5). More specifically, as shown in a computation block diagram of FIG. 6, the controller 21 is equipped, as its functional means, with a first pump discharge flow rate predicting-computing section 50, a second pump discharge flow rate predicting-computing section 51, a total flow rate predicting-computing section 52, a predictive engine speed .computing section 53, a filter 54, a learning-gain setting section 55, an antecedent-part conformability computing section 56, a consequent-part variable computing section 57, a control output torque computing section 58, and a control pressure converting section 59. The above-mentioned antecedent-part conformability computing section 56, consequent-part variable computing section 57, control output torque computing section 58, and control pressure converting section 59 as a whole constitute regulator control means. Note that the controller 21 is a general electronic controller constituted of devices such as a CPU, a RAM, a ROM, etc., and that the above-mentioned functional means 50 to 59 can be constituted by designing, as appropriate, a program that causes a CPU to operate.

A description will be given of each functional means. Initially, the first pump discharge flow rate predicting-computing section 50 is a means for predicting the flow rate Q1 of the pressure oil which is discharged from the first hydraulic pump 9, and predicts the discharge flow rate Q1 by the inlet pressure Pr1 of the relief valve 16, the hydraulic pump discharge pressure Pp, and the control pressure Ps in the previous step, employing the aforementioned regulator-characteristic shown in FIG. 5 (employing Eqs. (1) to (3)).

The second pump discharge flow rate predicting-computing section 51 is a means for predicting the flow rate Q2 of the pressure oil which is discharged from the second hydraulic pump 10, and predicts the discharge flow rate Q2 by the inlet pressure Pr2 of the relief valve 18, the hydraulic pump discharge pressure Pp, and the control pressure Ps in the previous step, employing the aforementioned regulator characteristic shown in FIG. 5 (employing Eqs. (1) to (3)).

The total flow rate predicting-computing section 52 is a means for computing a predictive total flow rate Q from the predictive discharge flow rates Q1 and Q2 computed by the first pump discharge flow rate predicting-computing section 50 and the second pump discharge flow rate predicting-computing section 51. The predictive total flow rate Q is represented by the following Eq. (4):

$$Q=(Q1+Q2) \quad (4)$$

Note that the above-mentioned first pump discharge flow rate predicting-computing section 50, second pump discharge flow rate predicting-computing section 51, and total flow rate predicting-computing section 52 as a whole constitute discharge-flow-rate predicting means.

The predictive engine speed computing section (predictive engine speed computing means) 53 is a means for computing an engine speed which is predicted from the present operating state. More specifically, the predictive engine speed computing section 53 computes the absorbed torque of the hydraulic pumps 9 and 10 from the hydraulic pump discharge pressure Pp and the predictive total flow rate Q, employing the aforementioned regulator characteristic of FIG. 5. Furthermore, the predictive engine speed computing section 53 computes an engine output which balances with the computed, absorbed pump torque and computes the predictive engine speed Nr of the engine 11 from the relationship between the engine output characteristic and the engine speed, shown in FIG. 3.

The reason why the predictive engine speed Nr of the engine 11 is computed in this manner is as follows: That is, an engine speed at which the engine 11 is able to produce a rated output stably is selected as a target engine speed. However, since load on the hydraulic pumps 9 and 10 is proportional to the product of flow rate and pressure, and the maximum flow rate is limited by the relief valves 16 and 18, the load on the hydraulic pumps 9 and 10 does not become great in the low-pressure region to a degree equivalent to the target engine speed. Because of this, in the case where machine operation at low pressure, such as light operation, is being performed, there are cases where the engine speed is not reduced to a target engine speed, and where, therefore, even if the engine speed is caused to follow the target engine speed, engine speed fluctuations will not be suppressed. Hence, in the controller 21 of the first embodiment, in order to suppress engine speed fluctuations more effectively, the predictive engine speed Nr of the engine 11 is computed, and an actual engine speed is caused to follow the predictive engine speed Nr instead of following the target engine speed. The computed predictive engine speed Nr is output to the filter 54.

The filter 54 is a means for performing a filter process, such as "dead time+first-order lag," on the predictive engine speed Nr computed by the predictive engine speed computing section 53. The filter 54 enables the actual engine speed Ne to smoothly follow the predictive engine speed Nr even in the case where the predictive engine speed Nr jumps up and down or contains a noise component. And the deviation ΔNe between the filtered predictive engine speed Nr and the actual engine speed Ne is input to the learning-gain setting section 55.

The learning-gain setting section 55 is a means for causing a learning gain to act on the deviation ΔNe between the filtered predictive engine speed Nr and the actual engine speed Ne. The learning gain may be merely the product of constants, or differentiation or integration of ΔNe, or the sum of them. The output of the learning-gain setting section 55 is positioned as an evaluation function for the engine speed deviation ΔNe and is expressed as f(ΔNe).

Thus, in the controller 21 of the first embodiment, an evaluation value f(ΔNe) that is an index for causing the actual engine speed Ne to follow the predictive engine speed Nr is derived from the inlet pressures Pr1 and Pr2 of the relief valves 16 and 18 and the hydraulic pump discharge pressure Pp and from the control pressure Ps in the previous step, by the aforementioned processes in the functional means 50 to 55. And as described later, the control pressure Ps is set so that the evaluation value f(ΔNe) becomes zero.

The controller 21 of the first embodiment employs fuzzy reasoning to control the regulators 12 and 13 with the control pressure Ps. More specifically, the hydraulic pump discharge pressure Pp, and the predictive total flow rate Q computed by the total flow rate predicting-computing section 52, are first input to the antecedent-part conformability computing section 56. The antecedent-part conformability computing section (conformability computing means) 56 is a means for computing the conformabilities of the input hydraulic pump discharge pressure Pp and predictive total flow rate Q relative to the antecedent part (if-part) of a fuzzy rule. The first embodiment employs a fuzzy rule such as the one shown in FIG. 7. More specifically, in FIG. 7, the part, described as NB, NM, . . . , and PB for the pump pressure Pp, and described as NB, NM, . . . , and PB for the predictive total flow rate Q, is equivalent to the antecedent part of the fuzzy rule. Also, Wij (where i=1 to 7 and j=1 to 7) in Table of FIG. 7 denotes a consequent-part variable and is to be described later.

The abridged symbols NB, NM, . . . , and PB in the antecedent part are called fuzzy labels. For instance, "NB" is an abridgment of "Negative Big," "NS" "Negative Small," and "PB" "Positive Big." For example, for the hydraulic pump discharge pressure Pp, "NB" means that pressure is fairly small and "PB" means that pressure is fairly big. For the predictive total flow rate Q, "NB" means that a rate of flow is fairly small and "PB" means that a rate of flow is fairly big. The aforementioned "conformability" is used to quantitate the coincidence of an input value (in the first embodiment, hydraulic pump discharge pressure Pp and predictive total flow rate Q) with each antecedent condition. In the case of fuzzy control, a membership function is used for the above-mentioned quantitation. As the membership function, there are various types such as a hanging bell type, a triangular type, etc. However, the first embodiment employs a triangular type membership function such as that shown in FIG. 8, from the viewpoint of calculation ease.

Figures 7, 8:
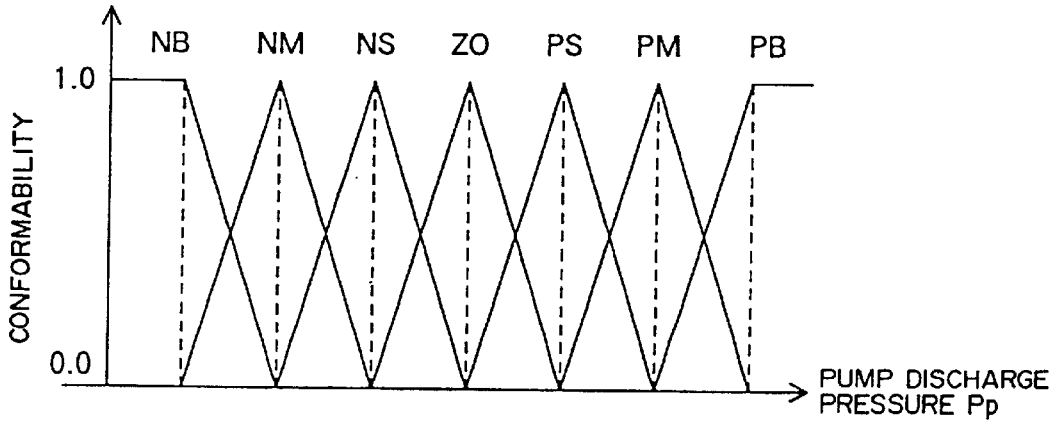
FIG. 7 is a diagram showing a fuzzy rule for fuzzy control used in the hydraulic-pump controller of the first embodiment of the present invention.
FIG. 8 is a diagram showing a membership function for the antecedent part of a fuzzy rule used in the hydraulic-pump controller of the first embodiment of the present invention.

FIG. 8 shows a membership function for the hydraulic pump discharge pressure Pp. For instance, in the case of an antecedent condition such as "if Pp is NM," a membership function corresponding to "NM" in FIG. 8 is employed to compute the value of the membership function for the input hydraulic pump discharge pressure Pp. The computed value is defined as the conformability for the antecedent condition "if Pp is NM." The same applies to other antecedent conditions. In addition, although not shown, the conformability of the input predictive total flow rate Q relative to each antecedent condition is computed by setting a similar membership function for the predictive total flow rate Q.

If the conformabilities of the input hydraulic pump discharge pressure Pp ,and predictive total flow rate Q relative to each antecedent condition are computed, the antecedent-part conformability computing section 56 computes a composite value of the conformabilities in the following manner. That is, a composite value $\mu ij$ of $\mu i$ and $\mu j$ (i=1 to 7 and j=1 to 7) is computed by the following Eq. (5):

$$\mu ij=\mu i\times\mu j \tag{5}$$

where $\mu j$ represents the conformability of the antecedent condition for the hydraulic pump discharge pressure Pp (j=1 corresponds to NB, j=2 to NM, . . . , and j=7 to PB) and $\mu i$ represents the conformability of the antecedent condition for the predictive total flow rate Q (i=1 corresponds to NB, i=2 to NM, . . . , and i=7 to PB). The composite value may be computed by the following Eq. (5'):

$$\mu ij=\min(\mu i, \mu j) \tag{5'}$$

where "min" is a function for selecting the minimum value. And the antecedent-part conformability computing section 56 outputs the computed composite conformability values $\mu ij$ to the consequent-part variable computing section 57 and the control output torque computing section 58.

The consequent-part variable computing section (learning-correction means) 57 is a means for computing the value of the consequent-part variable Wij in the fuzzy rule shown in FIG. 7. The consequent-part variable computing section 57 computes the consequent-part variable Wij to perform learning and a correction, based on the evaluation value f(ΔNe) computed by the learning-gain setting section 55 on the basis of the deviation ΔNe between the filtered predictive engine speed Nr and the actual engine speed Ne, and also based on the composite conformability value $\mu ij$ input from the antecedent-part conformability computing section 56. More specifically, the consequent-part variable computing section 57 computes the value of the consequent-part variable Wij by the following Eq. (6):

$$Wij(\mathrm{k})=Wij(k-1)-\Delta t\times f(\Delta Ne)\times\mu ij \tag{6}$$

where Δt is an incremental control time, ΔNe is the engine speed deviation, $\mu ij$ is the composite conformability value for the antecedent part (i=1 to 7 and j=1 to 7), Wij(k−1) is Wij in the previous step, and Wij(k) is Wij computed in the present step. Note that the computed value of each consequent-part variable Wij is stored in storage means provided within the controller 21.

The second term on the right-hand side of the above-mentioned Eq. (6) becomes greater, as the conformability of an antecedent condition becomes higher (if an antecedent condition has better coincidence), and as the evaluation value f(ΔNe) for the engine speed deviation ΔNe becomes greater. Therefore, the amount of amendment for the consequent-part variable Wij in the previous step becomes greater. And the second term on the right-hand side of the above-mentioned Eq. (6) changes until the evaluation value f(ΔNe) becomes zero, and the amendment (learning) of the consequent-part variable Wij is performed until the evaluation value f(ΔNe) becomes zero. The amended (learned) consequent-part variable Wij(k) is output to the control output torque computing section 58.

Note that if the set engine speed by the accelerator dial is changed, the target engine speed Nset for the engine 11 is also changed as shown in FIG. 4. Note that the controller 21 of the first embodiment employs a consequent-part variable Wij for each set engine speed by the accelerator dial and makes the learning and correction of the consequent-part variable Wij for each set engine speed.

The control output torque computing section 58 is a means for computing an output torque Tr which is output to the hydraulic pumps, and computes the output torque Tr from the consequent-part variable Wij(k) and the composite conformability value $\mu ij$, employing the following Eq. (7):

$$Tr=[\mu ij\cdot Wij(k)]/\Sigma\mu ij \tag{7}$$

The above-mentioned Eq. (7) is a calculation equation for a so-called weighted average and is a general method of computing an output value for fuzzy control. The computed output torque Tr is output to the control pressure converting section 59. And the control pressure converting section 59 is a means for converting the output torque Tr to a control pressure Ps. The control pressure Ps, obtained by converting the output torque Tr, is output to the electromagnetic proportional pressure-reducing valve 14.

Since the hydraulic-pump controller of the first embodiment of the present invention is constructed as described above, it operates in the following manner when a hydraulic construction machine with the hydraulic-pump controller is operated. If the operator first manipulates the manipulation levers 19 and 20, the direction switching valves 15 and 17 are switched so that the pressure oil according to the amount of the manipulation is supplied from the hydraulic pumps 9 and 10 to the hydraulic actuators 27 and 28. The inlet pressures Pr1 and Pr2 at the relief valves 16 and 18 are also changed according to the amount that the manipulation levers 19 and 20 are manipulated. The inlet pressures Pr1, and Pr2 are detected by the pressure sensors 23 and 24 and are output to the controller 21.

If the controller 21receives the inlet pressures Pr1 and Pr2, the first pump discharge flow rate predicting-computing section 50 and second pump discharge flow rate predicting-computing section 51 of the controller 21 predict and compute the discharge flow rates Q1 and Q2 of the hydraulic pumps 9 and 10 from the input pressures Pr1 and Pr2, hydraulic pump discharge pressure Pp, and control pressure Ps in the previous step, employing the regulator characteristic shown in FIG. 5. And the total flow rate predicting-computing section 52 computes the predictive total flow rate Q, employing Eq. (4).

If the predictive total flow rate Q is computed, the predictive engine speed computing section 53 computes the absorbed torque of the hydraulic pumps 9 and 10 from the predictive total flow rate Q and hydraulic pump discharge pressure Pp, computed by the use of the regulator characteristic of FIG. 5. Furthermore, the predictive engine speed computing section 53 computes an engine output that balances with the computed, absorbed pump torque, and computes the predictive engine speed Nr from the relationship between the engine output characteristic and the target engine speed, shown in FIG. 3. Then, the filter 54 performs a filter process, such as "dead time+first-order lag," on the computed predictive engine speed Nr. Furthermore, the learning-gain setting section 55 causes a predetermined learning gain to act on the deviation ΔNe between the filtered predictive engine speed Nr and the actual engine speed Ne, and then computes an evaluation value f(ΔNe) for the engine speed deviation ΔNe.

In addition to the computation of the evaluation value f(ΔNe) based on the inlet pressures Pr1, and Pr2, the antecedent-part conformability computing section 56 of the controller 21 computes the conformabilities $\mu j$ (j=1 to 7) and $\mu i$ (i=1 to 7) of the hydraulic pump discharge pressure Pp and predictive total flow rate Q relative to the antecedent part of the fuzzy rule shown in FIG. 7, employing a membership function such as that shown in FIG. 8. The antecedent-part conformability computing section 56 further computes the composite conformability value $\mu ij$ (i=1 to 7 and j=1 to 7), employing Eq. (5) or Eq. (5'). And based on the evaluation value f(ΔNe) for the engine speed deviation ΔNe and the composite conformability value $\mu ij$, the consequent-part variable computing section 57 amends (or learns) the value of each consequent-part variable Wij in the fuzzy rule shown in FIG. 7, employing Eq. (6). Since the second term of Eq. (6) changes until the evaluation value f(ΔNe) becomes zero, the amendment (learning) of the consequent-part variable Wij is performed until the evaluation value f(ΔNe) becomes zero.

If the amendment (learning) of the consequent-part variable Wij is performed, the control output torque computing section 58 computes an output torque Tr from the consequent-part variable Wij and the composite conformability value $\mu ij$, employing Eq. (7). And the control pressure converting section 59 converts the computed output torque Tr to a control pressure Ps and outputs it to the electromagnetic proportional pressure-reducing valve 14. The electromagnetic proportional pressure-reducing valve 14 performs electro-oil conversion on the control pressure Ps and inputs it to the regulators 12 and 13. The regulators 12 and 13 cause the swash plates 9*a* and 10*a* of the hydraulic pumps 9 and 10 to move according to the input control pressure Ps. In accordance with the angular displacements of the swash plates 9*a* and 10*a*, the discharge flow rates of the hydraulic pumps 9 and 10 are changed.

Thus, according to the hydraulic-pump controller of the first embodiment, the control pressure Ps for the regulators 12 and 13 of the hydraulic pumps 9 and 10 is set based on the engine speed Ne and the hydraulic pump discharge pressure Pp, and also based on the inlet pressures Pr1 and Pr2 of the relief valves 16 and 18 which are correlated with the amount that the manipulation levers 19 and 20 are manipulated. Therefore, the flow rates of the hydraulic pumps 9 and 10 during operation can be precisely predicted so that the actual engine speed Ne can follow the predictive engine speed Nr, without losing the balance between the engine output and the absorbed pump torque, immediately after lever manipulation, or during slight manipulation. Thus, the hydraulic-pump controller of the first embodiment has the advantage that operability degradation due to engine speed fluctuations can be prevented.

The hydraulic-pump controller is robust in control, because it employs fuzzy reasoning to control the hydraulic pumps 9 and 10 (more specifically, the regulators 12 and 13). The hydraulic-pump controller is also capable of manipulating the absorbed torque of the hydraulic pumps 9 and 10, according to the output states of the hydraulic pumps 9 and 10 being operated and to the response of the engine speed, because it learns and computes the control pressure Ps from the hydraulic pump discharge pressure Pp, the conformabilities $\mu j$ and $\mu i$ of the predictive total flow rate Q relative to each range, and the evaluation value f(ΔNe) for the deviation ΔNe of the actual engine speed Ne relative to the predictive engine speed Nr. That is, even if the output states of the hydraulic pumps 9 and 10 are changed by hydraulic shovel type, individual difference, etc., or the dynamic characteristic of the engine speed is changed by a change in working environment (e.g., a cold district, a warm district, etc.) or a change in fuel, the hydraulic pumps 9 and 10 can be controlled according to each hydraulic shovel and working environment, because the controller 21 itself learns the consequent-part variable Wij that is the basis for setting the control pressure Ps. Therefore, even if hydraulic shovel type or working environment varies, the same controller (control method) can be used. As a result, the tuning of control parameters for each machine type, and the operation of changing a control program, become unnecessary.

Furthermore, how the hydraulic pump discharge pressure Pp and the predictive total flow rate Q, which are input values for setting the control pressure Ps, make a transition depends on the amount that the manipulation levers 19 and 20 are manipulated, and characteristic changes, such as individual difference of engines and pumps, machine types, etc. However, if a membership function for the antecedent part of a fuzzy rule includes all the transition range, an antecedent condition most conformable to the aforementioned characteristic changes is treated as a computing object, and a consequent-part variable Wij corresponding to the antecedent condition which is a computing object is updated (or learned) to make the evaluation value f(ΔNe) zero. Therefore, control of the hydraulic pumps 9 and 10 corresponding to such characteristic changes can also be realized. Note that in a transition state, where changes are conspicuous, immediately after lever manipulation, the state may be divided into a plurality of intervals, depending on the elapsed time after manipulation. In this case, the consequent-part variable Wij is prepared for each interval, and the evaluation value f(ΔNe) in the learning-gain setting section 55 is set.

Now, a description will be given of a hydraulic-pump controller constructed according to a second embodiment of the present invention. The hydraulic-pump controller of the second embodiment, as with the above-mentioned first embodiment, is applied to a hydraulic construction machine, such as a hydraulic shovel, etc., shown in FIG. 1. The hydraulic-pump controller of the second embodiment also has the same hydraulic system as the first embodiment, such as that shown in FIG. 2. The hydraulic-pump controller of the second embodiment differs from the first embodiment in function (method of controlling hydraulic pumps). However, the relationship between the engine output characteristic and the target engine speed,shown in FIGS. 3 and 4, and the regulator characteristic of the hydraulic pumps shown in FIG. 5, are the same as the first embodiment.

Figure 9:
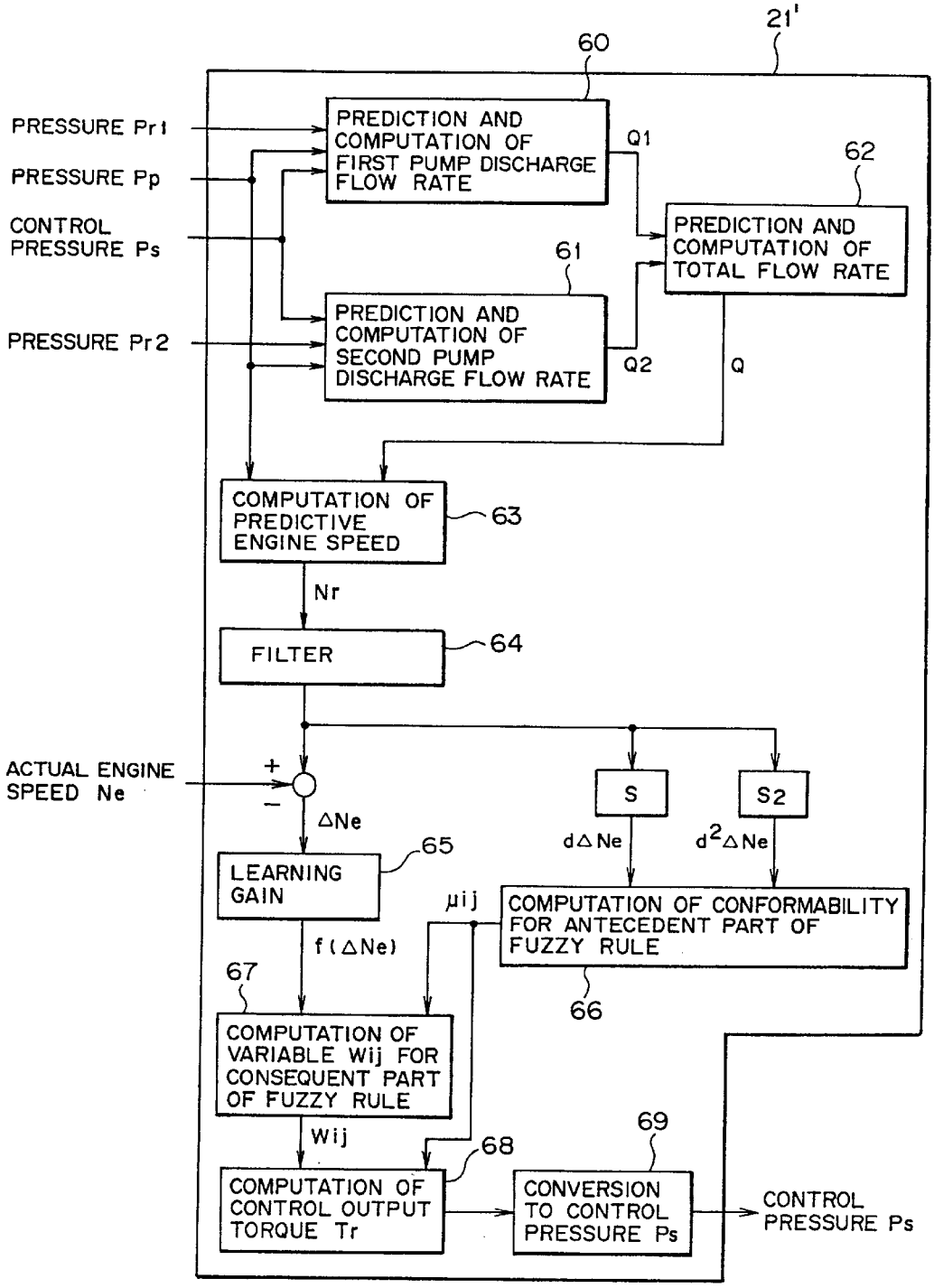
FIG. 9 is a block diagram showing the computation for pump control used in a hydraulic-pump controller of a second embodiment of the present invention.

Of the construction of the hydraulic-pump controller of the second embodiment, the function of the controller (method of controlling hydraulic pumps) will hereinafter be described primarily with reference to FIGS. 9 to 11 in addition to FIGS. 2 to 5 used in the first embodiment. As shown in a computation block diagram of FIG. 9, the controller 21' of the second embodiment is equipped with a first pump discharge flow rate predicting-computing section 60, a second pump discharge flow rate predicting-computing section 61, a total flow rate predicting-computing section 62, a predictive engine speed computing section 63, a filter 64, a learning-gain setting section 65, an antecedent-part conformability computing section 66, a consequent-part variable computing section 67, a control output torque computing section 68, and a control pressure converting section 69. Note that the controller 21' is a general electronic controller constituted of devices such as a CPU, a RAM, a ROM, etc., and that the above-mentioned functional means 60 to 69 can be constituted by designing, as appropriate, a program which causes a CPU to operate.

A description will be given of each functional means. The first pump discharge flow rate predicting-computing section 60 is a means for predicting the flow rate Q1 of the pressure oil, which is discharged from a first hydraulic pump 9, by the inlet pressure Pr1 of a relief valve 16, the hydraulic pump discharge pressure Pp, and the control pressure Ps in the previous step, employing the regulator characteristic shown in FIG. 5.

The second pump discharge flow rate predicting-computing section 61 is a means for predicting the flow rate Q2 of the pressure oil, which is discharged from a second hydraulic pump 10, by the inlet pressure Pr2 of a relief valve 18, the hydraulic pump discharge pressure Pp, and the control pressure Ps in the previous step, employing the regulator characteristic shown in FIG. 5.

The total flow rate predicting-computing section 62 is a means for computing a predictive total flow rate Q from the predictive discharge flow rates Q1 and Q2 computed by the first pump discharge flow rate predicting-computing section 60 and the second pump discharge flow rate predicting-computing section 61, employing Eq. (4), as with the first embodiment. Note that the above-mentioned first pump discharge flow rate predicting-computing section 60, second pump discharge flow rate predicting-computing section 61, and total flow rate predicting-computing section 62 as a whole constitute discharge-flow-rate predicting means.

The predictive engine speed computing section (predictive engine speed computing means) 63 is a means for computing engine speed. The predictive engine speed computing section 63 computes the absorbed torque of the hydraulic pumps 9 and 10 from the hydraulic pump discharge pressure Pp and the predictive total flow,rate Q, employing the regulator characteristic of FIG. 5. Furthermore, the predictive engine speed computing section 63 computes an engine output which balances with the computed, absorbed pump torque and computes the predictive engine speed Nr of the engine 11 from the relationship between the engine output characteristic and the engine speed, shown in FIG. 3.

The filter 64 is a means for performing a filter process, such as "dead time+first-order lag," on the predictive engine speed Nr, computed by the predictive engine speed computing section 63, so that even in the case where the predictive engine speed Nr varies by stages or contains a noise component, the actual engine speed Ne can follow the predictive engine speed Nr smoothly.

The learning-gain setting section 65 is a means for causing a learning gain to act on the deviation ΔNe between the filtered predictive engine speed Nr and the actual engine speed Ne to compute an evaluation function f(ΔNe) for the engine speed deviation ΔNe. The learning gain may be the product of constants, or differentiation or integration of ΔNe, or the sum of them.

The functions of the above-mentioned functional means 60 to 65 are the same as those of the functional means 50 to 55 of the first embodiment. To cause the actual engine speed Ne to follow the predictive engine speed Nr, the controller 21' sets the control pressure Ps so that the evaluation value f(ΔNe) derived by the functional means 60 to 65 becomes zero. The second embodiment also employs fuzzy control to control the regulators 12 and 13 with the control pressure Ps, but differs from the first embodiment in how to control the fuzzy control.

More specifically, in the second embodiment, the first-order differentiated value dΔNe and second-order differentiated value $d^2$ΔNe of the predictive engine speed filtered by the filter 64 are input to the antecedent-part conformability computing section 66 as input values for fuzzy control. The antecedent-part conformability computing section (conformability computing means) 66 is a means for computing the conformabilities of the first-order differentiated value dΔNe and second-order differentiated value $d^2$ΔNe of an input predictive engine speed relative to the antecedent part of a fuzzy rule. The second embodiment employs a fuzzy rule such as the one shown in FIG. 10. In the figure, the part, described as NB, NM, . . . , and PB for the first-order differentiated value dΔNe, and described as NB, NM, . . . , and PB for the second-order differentiated value $d^2$ ΔNe, is equivalent to the antecedent part of the fuzzy rule.

The conformability is used for quantitating the coincidence of an input value (in the second embodiment, the first-order differentiated value dΔNe and the second-order differentiated value $d^2$ΔNe) with each antecedent condition (i.e., NB, NM, . . . , and PB). The second embodiment performs quantitation, employing a membership function such as that shown in FIG. 11. As the membership function, there are various types such as a hanging bell type, a triangular type, etc. However, the second embodiment employs a triangular type membership function from the viewpoint of calculation ease. FIG. 11 shows a membership function for the first-order differentiated value dΔNe. For instance, in the case of an antecedent condition such as "if dΔNe is NM," a membership function corresponding to "NM" in FIG. 11 is employed to compute the value of the membership function for the input first-order differentiated value dΔNe. The computed value is defined as the conformability for the antecedent condition "if dΔNe is NM." The same applies to other antecedent conditions. In addition, although not shown, the conformability of an input second-order differentiated value $d^2\Delta Ne$ relative to each antecedent condition is computed by setting a similar membership function for the second-order differentiated value $d^2\Delta Ne$.

If the conformabilities of the input first-order differentiated value dΔNe and second-order differentiated value $d^2\Delta Ne$ with each antecedent condition are computed, the antecedent-part conformability computing section 66 computes a composite value of the conformabilities. That is, a composite value $\mu ij$ of $\mu i$ and $\mu j$ (i=1 to 7 and j=1 to 7) is computed, employing by the aforementioned Eq. (5) or, Eq. (5'), as with first embodiment. In this case, $\mu j$ represents the conformability of the antecedent condition for the first-order differentiated value dΔNe (j=1 corresponds to NB, j=2 to NM, . . . , and j=7 to PB) and $\mu i$ represents the conformability of the antecedent condition for the second-order differentiated value $d^2\Delta Ne$ (i=1 corresponds to NB, i=2 to NM, . . . , and i=7 to PB).

Figures 10, 11:
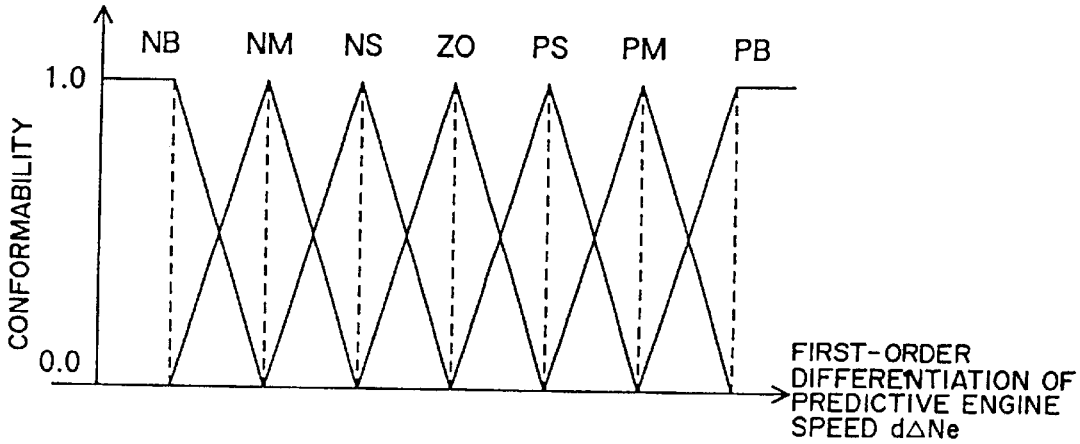
FIG. 10 is a diagram showing a fuzzy rule for fuzzy control used in the hydraulic-pump controller of the second embodiment of the present invention.
FIG. 11 is a diagram showing a membership function for the antecedent part of a fuzzy rule used in the hydraulic-pump controller of the second embodiment of the present invention.
Figure 12:
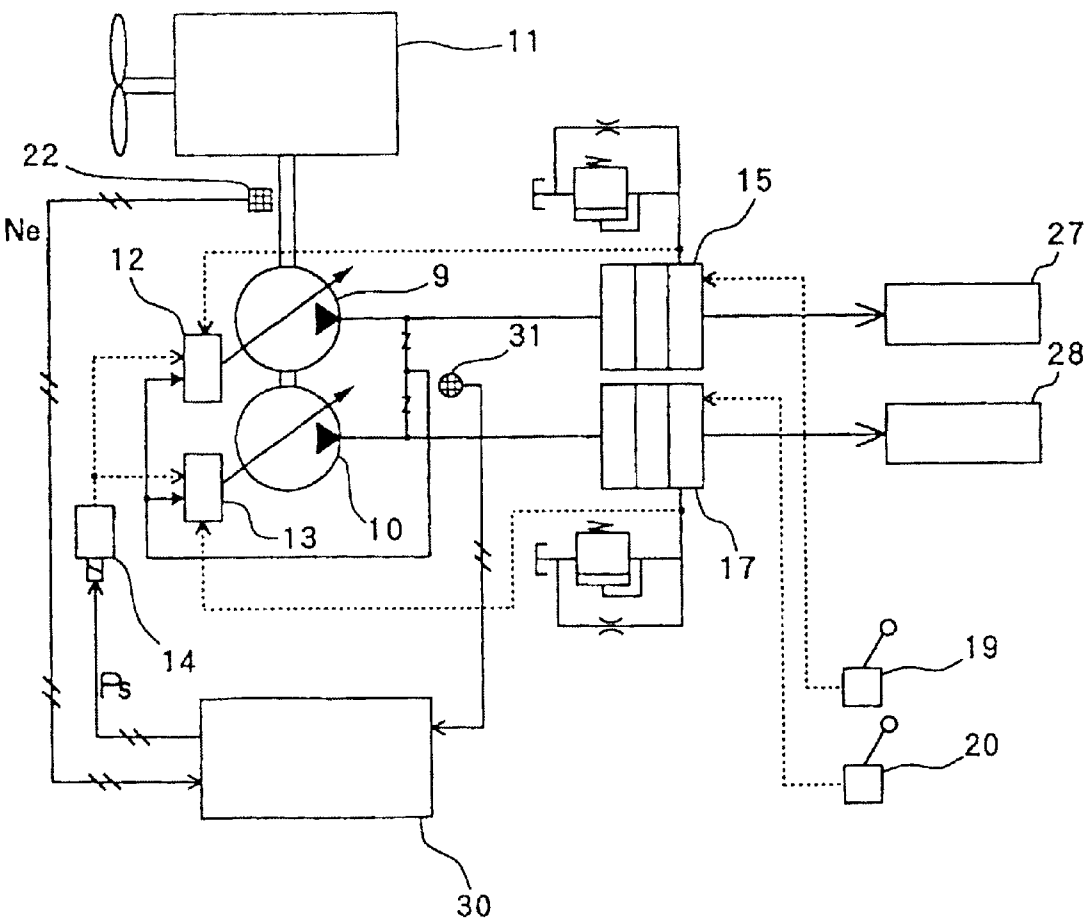
FIG. 12 PRIOR ART
FIG. 12 is a block diagram showing the construction of a hydraulic system used in a conventional hydraulic-pump controller.

The consequent-part variable computing section (learning-correction means) 67 is a means for computing the value of the consequent-part variable Win in the fuzzy rule shown in FIG. 10. Based on the evaluation value f(ΔNe) computed by the learning-gain setting section 65 on the basis of the deviation ΔNe between the filtered predictive engine speed Nr and the actual engine speed Ne, and also based on the composite conformability value $\mu ij$ input from the antecedent-part conformability computing section 66, the consequent-part variable computing section 67 computes the consequent-part variable Wij to perform learning and a correction, employing Eq. (6), as with the first embodiment. The computed Wij is stored in storage means provided within the controller 21'. Note that the consequent-part variable Wij is prepared for each accelerator dial, and that the consequent-part variable computing section 67 makes the learning and correction of the consequent-part variable Wij for each accelerator dial.

The consequent-part variable Wij computed by the consequent-part variable computing section 67, along with the composite conformability value $\mu ij$ computed by the antecedent-part conformability computing section 66, is input to the control output torque computing section 68. The control output torque computing section 68 is a means for computing an output torque Tr which is output to the hydraulic pumps, and computes the output torque Tr from the consequent-part variable Wij(k) and the composite conformability value $\mu ij$, employing the aforementioned Eq. (7) (which is a weighted average), as with the first embodiment. And the output torque Tr computed by the control output torque computing section 68 is converted to control pressure Ps by the control pressure converting section 69 and is output to the electromagnetic proportional pressure-reducing valve 14. The above-mentioned antecedent-part conformability computing section 66, consequent-part variable computing section 67, control output torque computing section 68, and control pressure converting section 69 as a whole constitute regulator control means.

Since the hydraulic-pump controller of the second embodiment of the present invention is constructed as described above, it operates in the following manner when a hydraulic construction machine with the hydraulic-pump controller is operated. If the operator first manipulates the manipulation levers 19 and 20, the direction switching valves 15 and 17 are switched so that the pressure oil according to the amount of the manipulation is supplied from the hydraulic pumps 9 and 10 to the hydraulic actuators 27 and 28. The inlet pressures Pr1 and Pr2 at the relief valves 16 and 18 are also changed according to the amount that the manipulation levers 19 and 20 are manipulated. The inlet pressures Pr1 and Pr2 are detected by the pressure sensors 24 and 25 and are output to the controller 21'.

If the controller 21' receives the inlet pressures Pr1 and Pr2, the first pump discharge flow rate predicting-computing section 60 and second pump discharge flow rate predicting-computing section 61 of the controller 21' predict and compute the discharge flow rates Q1 and Q2 of the hydraulic pumps 9 and 10 from the input pressures Pr1 and Pr2, hydraulic pump discharge pressure Pp, and control pressure Ps in the previous step, employing the regulator characteristic shown in FIG. 5. And the total flow rate predicting-computing section 62 computes the predictive total flow rate Q, employing the aforementioned Eq. (4).

Next, the predictive-engine speed computing section 63 computes the absorbed torque of the hydraulic pumps 9 and 10 from the predictive total flow rate Q and hydraulic pump discharge pressure Pp, computed using the regulator characteristic of FIG. 5. Furthermore, the predictive engine speed computing section 63 computes an engine output that balances with the computed, absorbed pump torque, and computes the predictive engine speed Nr from the relationship between the engine output characteristic and the target engine speed, shown in FIG. 3. Then, the filter 64 performs the aforementioned filter process on the computed predictive engine speed Nr. Furthermore, the learning-gain setting section 65 causes a predetermined learning gain to act on the deviation ΔNe between the filtered predictive engine speed Nr and the actual engine speed Ne, and then computes an evaluation value f(ΔNe) for the engine speed deviation ΔNe.

In addition to the computation of the evaluation value f(ΔNe) based on the inlet pressures Pr1 and Pr2, the antecedent-part conformability computing section 66 of the controller 21' computes the conformabilities $\mu j$ (j=1 to 7) and $\mu i$ (i=1 to 7) of the first-order differentiated value dΔNe and second-order differentiated value $d^2\Delta Ne$ of the predictive engine speed relative to the antecedent part of the fuzzy rule shown in FIG. 10, employing a membership function such as that shown in FIG. 11. The antecedent-part conformability computing section 66 further computes the composite conformability value $\mu ij$ (i=1 to 7 and j=1 to 7), employing Eq. (5) or Eq. (5'). And based on the evaluation value f(ΔNe) and the composite conformability value $\mu ij$, the consequent-part variable computing section 67 amends (or learns) the value of each consequent-part variable Wij in the fuzzy rule shown in FIG. 11, employing Eq. (6). Since the second term of Eq. (6) changes until the evaluation value f(ΔNe) becomes zero, the amendment (learning) of the consequent-part variable Wij is performed until the evaluation value f(ΔNe) becomes zero.

If the amendment (learning) of the consequent-part variable Wij is performed, the control output torque computing section 68 computes an output torque Tr from the consequent-part variable Wij and the composite conformability value $\mu ij$, employing Eq. (7). And the control pressure converting section 69 converts the computed output torque Tr to a control pressure Ps and outputs it to the electromagnetic proportional pressure-reducing valve 14. The electromagnetic proportional pressure-reducing valve 14 performs electro-oil conversion on the control pressure Ps and inputs it to the regulators 12 and 13. The regulators 12 and 13 cause the swash plates 9*a* and 10*a* of the hydraulic pumps 9 and 10 to move according to the input control pressure Ps. In accordance with the angular displacements of the swash plates 9*a* and 10*a*, the discharge flow rates of the hydraulic pumps 9 and 10 are changed.

Thus, according to the hydraulic-pump controller of the second embodiment, as with the first embodiment, the control pressure Ps for the regulators 12 and 13 of the hydraulic pumps 9 and 10, is set based on the engine speed Ne and the hydraulic pump discharge pressure Pp, and also based on the inlet pressures Pr1 and Pr2 of the relief valves 16 and 18 which are correlated with the amount that the manipulation levers 19 and 20 are manipulated. Therefore, the flow rates of the hydraulic pumps 9 and 10 during operation can be precisely predicted so that the actual engine speed Ne can follow the predictive engine speed Nr, without losing the balance between the engine output and the absorbed pump torque, immediately after lever manipulation, or during slight manipulation. Thus, the hydraulic-pump controller of the second embodiment has the advantage that operability degradation due to engine speed fluctuations can be prevented.

The hydraulic-pump controller of the second embodiment is robust in control, because it employs fuzzy reasoning to control the hydraulic pumps 9 and 10 (more specifically, the regulators 12 and 13). The hydraulic-pump controller is also capable of manipulating the absorbed torque of the hydraulic pumps 9 and 10, according to the output states of the hydraulic pumps 9 and 10 being operated and to the response of the engine speed, because it learns and computes the control pressure Ps from the conformabilities, $\mu j$ and $\mu i$ of the first-order differentiated value $d\Delta Ne$ and second-order differentiated value $d^2\Delta Ne$ of the predictive engine speed relative to the antecedent part of the fuzzy rule, and from the evaluation value $f(\Delta Ne)$ for the deviation $\Delta Ne$ of the actual engine speed Ne relative to the predictive engine speed Nr. Therefore, even if hydraulic shovel type or working environment varies, the same controller (control method) can be used, as with the first embodiment. As a result, the tuning of control parameters for each machine type, and the operation of changing a control program, become unnecessary. Note that as with the first embodiment, in a transition state, where changes are conspicuous, immediately after lever manipulation, the state may be divided into a plurality of intervals, depending on the elapsed time after manipulation. In this case, the consequent-part variable Wij is prepared for each interval, and the evaluation value $f(\Delta Ne)$ in the learning-gain setting section 65 is set.

While the present invention has been described with reference to the two preferred embodiments thereof, the invention is not to be limited to the details given herein, but may be modified within the scope of the appended claims. For example, although, in the aforementioned embodiments, the inlet pressures Pr1 and Pr2 at the relief valves 16 and 18 are detected as physical quantities correlating with the amount that the manipulation levers 19 and 20 are manipulated, the manipulation amount itself may be detected to predict the discharge flow rate Q.

In addition, in the embodiments described above, the antecedent condition of the fuzzy rule is set according to the hydraulic pump discharge pressure Pp and the predictive total flow rate Q, or according to the first-order differentiated value $d\Delta Ne$ and second-order differentiated value $d^2\Delta Ne$ of the predictive engine speed. However, the antecedent condition of the fuzzy rule is not limited to the aforementioned physical quantities (Pp, Q, $d\Delta Ne$, and $d^2\Delta Ne$), if it is a physical quantity representing the operating state of the hydraulic system. The antecedent condition may be set according to three or more physical quantities, or a single quantity.

INDUSTRIAL APPLICABILITY

As has been described above, the hydraulic-pump controller of the present invention is suitable for a hydraulic construction machine with a hydraulic system constructed of an engine, hydraulic pumps, hydraulic actuators, etc.

What is claimed is:

1. A hydraulic-pump controller which is equipped in a hydraulic system, in which hydraulic pumps are driven by an engine so that operating oil is supplied to hydraulic actuators manipulated by manipulation means, and which also controls regulators of said hydraulic pumps so that absorbed torque of said hydraulic pumps balances with an output of said engine, said hydraulic-pump controller comprising:

engine speed detection means for detecting engine speed of said engine;

discharge pressure detection means for detecting discharge pressure of said hydraulic pumps;

manipulation-amount detection means for detecting an amount that said manipulation means is manipulated, or a physical quantity correlating with said amount;

discharge flow rate predicting means for predicting discharge flow rates of the operating oil which are discharged from said hydraulic pumps according to manipulation of said manipulation means, based on an output of said discharge pressure detection means and an output of said manipulation-amount detection means;

predictive engine speed computing means for calculating the absorbed torque of said hydraulic pumps, based on said discharge flow rates predicted by said discharge flow rate predicting means and an output of said discharge pressure detection means, and then computing a predictive engine speed of said engine from the calculated absorbed torque of said hydraulic pumps; and regulator control means for controlling said regulators, based on a deviation between said predictive engine speed computed by said predictive engine speed computing means and an actual engine speed detected by said engine speed detection means.

2. The hydraulic-pump controller as set forth in claim 1, wherein said regulator control means is a means for controlling said regulators by employing fuzzy reasoning and includes conformability computing means for setting a plurality of antecedent conditions in accordance with a range of operating states of said hydraulic system and then computing conformability of each said antecedent condition relative to physical quantities representing said operating states; and learning-correction means for setting a plurality of control parameters for controlling said regulators, in accordance with said antecedent conditions, and for learning and correcting each of said control parameters, based on both said deviation between said predictive engine speed and said actual engine speed and said conformability of each said antecedent condition computed by said conformability computing means, and then outputting the corrected control parameters to said regulators.

3. The hydraulic-pump controller as set forth in claim 2, wherein said discharge pressure and said discharge flow rates are treated as said physical quantities representing said operating states and wherein said antecedent conditions are set in accordance with said discharge pressure and said discharge flow rates.

4. A hydraulic-pump controller which is equipped in a hydraulic system, in which hydraulic pumps are driven by an engine so that operating oil is supplied to hydraulic actuators manipulated by manipulation means and which also controls regulators of said hydraulic pumps so that absorbed torque of said hydraulic pumps balances with an output of said engine, said hydraulic-pump controller comprising:

engine speed detection means for detecting engine speed of said engine;

discharge pressure detection means for detecting discharge pressure of said hydraulic pumps;

manipulation-amount detection means for detecting an amount that said manipulation means is manipulated, or a physical quantity correlating with said amount;

discharge flow rate predicting means for predicting discharge flow rates of the operating oil which are discharged from said hydraulic pumps according to manipulation of said manipulation means, based on an output of said discharge pressure detection means and an output of said manipulation-amount detection means;

predictive engine speed computing means for calculating the absorbed torque of said hydraulic pumps, based on said discharge flow rates predicted by said discharge flow rate predicting means and an output of said discharge pressure detection means, and then computing a predictive engine speed of said engine from the calculated absorbed torque of said hydraulic pumps; and regulator control means for controlling said regulators, based on a deviation between said predictive engine speed computed by said predictive engine speed computing means and an actual engine speed detected by said engine speed detection means, wherein said regulator control means is a means for controlling said regulators by employing fuzzy reasoning and includes conformability computing means for setting a plurality of antecedent conditions in accordance with a range of operating states of said hydraulic system and then computing conformability of each said antecedent condition relative to physical quantities representing said operating states; and learning-correction means for setting a plurality of control parameters for controlling said regulators, in accordance with said antecedent conditions, and for learning and correcting each of said control parameters, based on both said deviation between said predictive engine speed and said actual engine speed and said conformability of each said antecedent condition computed by said conformability computing means, and then outputting the corrected control parameters to said regulators, and, wherein a first-order differentiated value and a second-order differentiated value of said predictive engine speed are treated as said physical quantities representing said operating states and wherein said antecedent conditions are set in accordance with said first-order differentiated value and said second-order differentiated value.

* * * * *